US007326038B2

(12) United States Patent
Iimura et al.

(10) Patent No.: US 7,326,038 B2
(45) Date of Patent: Feb. 5, 2008

(54) PRESSURE SWITCH MECHANISM AND AIR COMPRESSOR USING THE SAME MECHANISM

(75) Inventors: Yoshio Iimura, Ibaraki (JP); Hiroaki Orikasa, Ibaraki (JP); Mitsuhiro Sunaoshi, Ibaraki (JP); Kazuhiro Segawa, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 558 days.

(21) Appl. No.: 10/873,238

(22) Filed: Jun. 23, 2004

(65) Prior Publication Data

US 2004/0265132 A1 Dec. 30, 2004

(30) Foreign Application Priority Data

Jun. 24, 2003 (JP) ..... P2003-178919

(51) Int. Cl.
*F04B 49/00* (2006.01)
*F04B 49/06* (2006.01)

(52) U.S. Cl. ..... 417/44.2; 417/44.1; 417/20

(58) Field of Classification Search ..... 417/44.2, 417/44.1, 53, 20, 12, 28, 26, 290; 141/95
See application file for complete search history.

(56) References Cited

U.S. PATENT DOCUMENTS 4,863,355 A * 9/1989 Odagiri et al. ..... 417/12
6,089,835 A 7/2000 Suzuura et al.
6,419,454 B1 * 7/2002 Christiansen ..... 417/4

FOREIGN PATENT DOCUMENTS

| | | |
|---|---|---|
| DE | 32 37 251 A1 | 4/1984 |
| JP | 63-106382 | 5/1988 |
| JP | 1-74389 | 5/1989 |
| JP | 2-176174 | 7/1990 |
| JP | 3-164585 | 7/1991 |
| JP | 3-246385 | 11/1991 |
| JP | 7-167102 | 7/1995 |

OTHER PUBLICATIONS

Japanese Office Action dated Oct. 15, 2007 with English language translation.

* cited by examiner

*Primary Examiner*—Anthony D. Stashick
*Assistant Examiner*—Jessica L Frantz
(74) *Attorney, Agent, or Firm*—McGinn IP Law Group, PLLC

(57) ABSTRACT

An air compressor comprises a tank portion for reserving a compressed air, a compressed air generating portion for generating the compressed air to be supplied to the tank portion, a motor for driving the compressed air generating portion, and a pressure switch mechanism having a pressure sensor in a part of the tank portion, and controlling the motor to be turned on or off in accordance with an output of the pressure sensor, characterized in that when the time change rate of the pressure within air tank is greater than a predetermined value, the motor is restarted without waiting until the pressure decreases to the switch on point at the time of pressure fall.

17 Claims, 5 Drawing Sheets

PRESSURE SWITCH MECHANISM AND AIR COMPRESSOR USING THE SAME MECHANISM

BACKGROUND OF THE INVENTION

1. Field of the Invention

The present invention relates to an air compressor for generating a compressed air for use with an air tool such as a pneumatic nailing machine, and more particularly to an air compressor having long continuous working time up to reaching a working critical pressure, and a pressure switch mechanism for use therewith.

2. Description of the Related Art

Generally, the air compressor for use with the air tool compresses the air sucked via a suction valve by rotationally driving a crank shaft of a compressor main body with a motor, and reciprocating a piston within a cylinder by rotations of the crank shaft. And a compressed air produced in the compressor main body is discharged via an exhaust valve through a pipe into an air tank, and reserved within the tank. The air tool makes the nailing operation or the like, employing the compressed air reserved within this tank.

Some of the air compressors for the air tool constituted in the above manner may be sometimes used as an installed type, but mostly used as a portable type, and brought into the building site for use. Accordingly, the discharge amount, namely, compressed air production capability is relatively small in most cases. Also, it is required that the air compressor is as small as possible and has excellent portability.

For the reason of safety, the compressor has a function of stopping the motor, if the pressure within tank reaches a specified value, and restarting the motor if the pressure within tank falls below the specified value by the use of the air tool. A pressure switch implements this function. That is, the pressure switch detects the air pressure within tank with a pressure sensor, and turns on or off the motor in accordance with a signal from the sensor.

FIG. 6 shows the operation of the conventional pressure switch. The longitudinal axis represents the air pressure within tank (kg/cm$^2$), and the transverse axis represents the time (min). Reference sign PH denotes a pressure switch off point at the time of pressure buildup, PB denotes a pressure switch on point at the time of pressure fall, and PL denotes a working critical pressure.

In the prior art, PB is set at such a value as PB=(0.8 to 0.85)*PH. The reason is that since the pressure within tank gradually decreases due to a fall in temperature within tank and air leakage after the motor is stopped at PH point, if there is a small difference between PH and PB, the motor is repeatedly started and stopped at high frequency without use of the air tool, and oscillated. Therefore, PB is set at such value to prevent occurrence of this phenomenon.

In FIG. 6, if the motor is started in a state where there is no air consumption and the pressure within tank is zero, the pressure within tank increases, and the motor is stopped at point a of reaching PH. If the air tool with smaller air consumption is continuously employed immediately after the motor is stopped, the pressure within tank decreases relatively gradually, and the motor is restarted at point b of reaching PB. And the pressure within tank increases again, and at point c of reaching PH, the motor is stopped. If the air tool with a large amount of air consumption is continuously employed immediately after the motor is stopped at point c, the pressure within tank decreases rapidly, and at point d of reaching PB, the motor is restarted. However, because the air production amount does not follow the air consumption amount, the pressure within tank continues to fall, and finally at point e, the working critical pressure PL is reached, making it impossible to continue the subsequent operation. In this case, it is required that the operation is interrupted to wait until the pressure within tank increases, and then the next operation is performed.

Accordingly, there is a problem with the prior art that when the air tool with a large amount of air consumption is employed, the continuous serviceable time is shorter.

SUMMARY OF THE INVENTION

It is an object of the invention to solve the above-mentioned problem with the prior art, and provide an air compressor having a long continuous serviceable time when an air tool with a large amount of air consumption is employed, and a pressure switch mechanism for use therewith.

In order to accomplish the above object, the present invention provides a pressure switch mechanism including a pressure vessel, a pressure sensor which senses a pressure within the pressure vessel, a load, a switching unit which switches a feed line of the load and a control unit which controls the switching unit in accordance with a signal of the pressure sensor, characterized in that the control unit controls the switching unit to be turned on when a pressure of the pressure vessel is a first value, of turned off when a pressure of the pressure vessel is a second value greater than the first value, and turned on at a third value between the first and second values when a pressure change rate of the pressure vessel is greater than or equal to a predetermined value.

Also, the invention provides an air compressor including a tank portion which reserves a compressed air, a compressed air generating portion which generates the compressed air to be supplied to the tank portion, a motor driving the compressed air generating portion, a switching unit which switches a feed line of the motor, a pressure sensor which senses a pressure of the tank portion and a control unit controlling the switching unit to be turned on or off in accordance with a signal of the pressure sensor, characterized in that the control units controls the switching unit to be turned on when the pressure of the tank portion is a first value, or turned off when the pressure of the tank portion is a second value, and turned on at a third value different from the first and second values when a pressure change rate of the tank portion is greater than or equal to a predetermined value.

The air compressor of the invention is characterized in that the second value is greater than the first value, and the third value has a magnitude between said first and second values.

The air compressor of the invention is characterized in that the air compressor further includes an air compressor and an air tool connected to the air compressor, in which the pressure of the tank portion is sensed at a time interval at which ripples in the pressure of the tank portion caused by the use of the air tool can be detected.

Also, the invention provides a control method for an air compressor that includes a tank portion which reserves a compressed air, a compressed air generating portion which generates the compressed air to be supplied to the tank portion, a motor driving the compressed air generating portion, a switching unit which switches a feed line of the motor, a pressure sensor which senses a pressure of the tank portion, a control unit controlling the switching unit to be turned on or off in accordance with a signal of the pressure sensor, the method including detecting the pressure P(i) of the tank portion and stopping the motor when said pressure P(i) is greater than a first predetermined value, sensing a pressure P($i$+1) of the tank portion after a certain time ΔT1, calculating a pressure change rate from a difference ΔP1 between pressures P($i$+1) and P($i$) and the certain time ΔT1 and driving the motor when the pressure change rate is greater than a predetermined value and the pressure P($i$) is smaller than a first pressure value.

Other features and advantages of the invention will be understood more clearly from the following description.

DETAILED DESCRIPTION OF THE PREFERRED EMBODIMENTS

The preferred embodiments of the present invention will be described below in detail.

Figure 4:
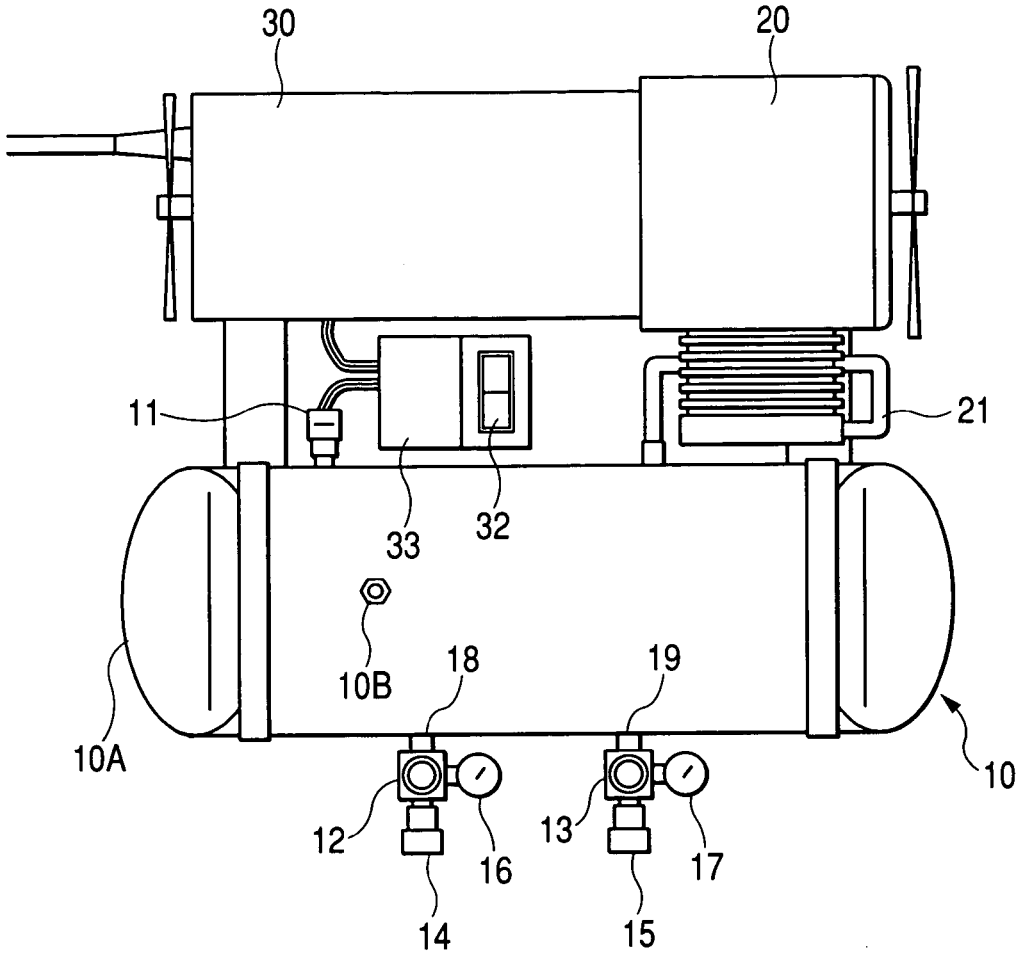
FIG. 4 is an upper view showing the air compressor according to the invention.

An air compressor according to this invention comprises a tank portion 10 for reserving the compressed air, a compressed air generating portion 20 for generating the compressed air, a motor 30 for driving the compressed air generating portion 20, and a pressure switch 33 for turning on or off the motor 30, as shown in FIG. 4.

The tank portion 10 has an air tank 10A for reserving the compressed air, in which a compressed air of 6 to 10 kg/cm$^2$ is supplied through a pipe 21 connected to a discharge opening of the compressed air generating portion 20. The air tank 10A is provided with a plurality of compressed air takeoff openings 18, 19, which are connected via the pressure reducing valves 12, 13 to the couplers 14, 15. The pressure reducing valves 12, 13 have the maximum pressure of compressed air on the outlet side which is preset irrespective of the pressure of compressed air on the inlet side, in which the maximum pressure is chosen at a predetermined value in a range from 6 to 8 kg/cm$^2$ in this embodiment. Accordingly, the compressed air at or below the maximum pressure is obtained from the outlet side of the pressure reducing valves 12, 13, irrespective of the pressure of the air tank 10A.

The pressure reducing valves 12 and 13 have the pressure gauges 16 and 17 attached to monitor the pressure of compressed air on the outlet side of the pressure reducing valves 12 and 13. A pressure sensor 11 for detecting the pressure of compressed air within the tank 10A is mounted in a part of the air tank 10A. This detection signal is sent to a pressure switch 33. A safety valve 10B is mounted in a part of the air tank 10A. The safety vale 10B secures the safety by allowing a part of the air to escape to the outside, when the pressure within the air tank 10A is abnormally increased.

The compressed air generating portion 20 generates the compressed air by reciprocating a piston within a cylinder, and compressing the air pulled into the cylinder through a suction valve of the cylinder, in which the constitution of the compressor itself is already well known. For example, in U.S. Pat. No. 6,089,835 as filed by the same applicant as this invention, a mechanism has been disclosed in which the rotation of the motor is transmitted via a pinion provided at the distal end of the rotor shaft and a gear meshed with the pinion to the output shaft, and the piston is reciprocated by movement of the output shaft.

If the piston is reciprocated within the cylinder, the air drawn by a suction valve provided in the cylinder head is compressed to reach a predetermined pressure, so that the compressed air is achieved through an exhaust valve provided in the cylinder head. This compressed air is supplied through a pipe 21 to the air tank 10A, as shown in FIG. 4.

Figure 5:
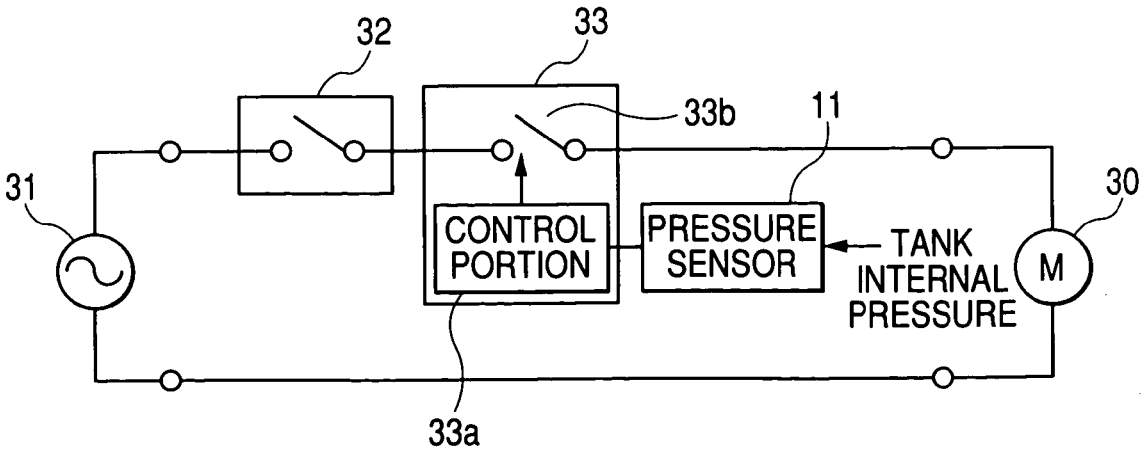
FIG. 5 is an electric circuit diagram for use with the air compressor according to the invention.
Figure 6:
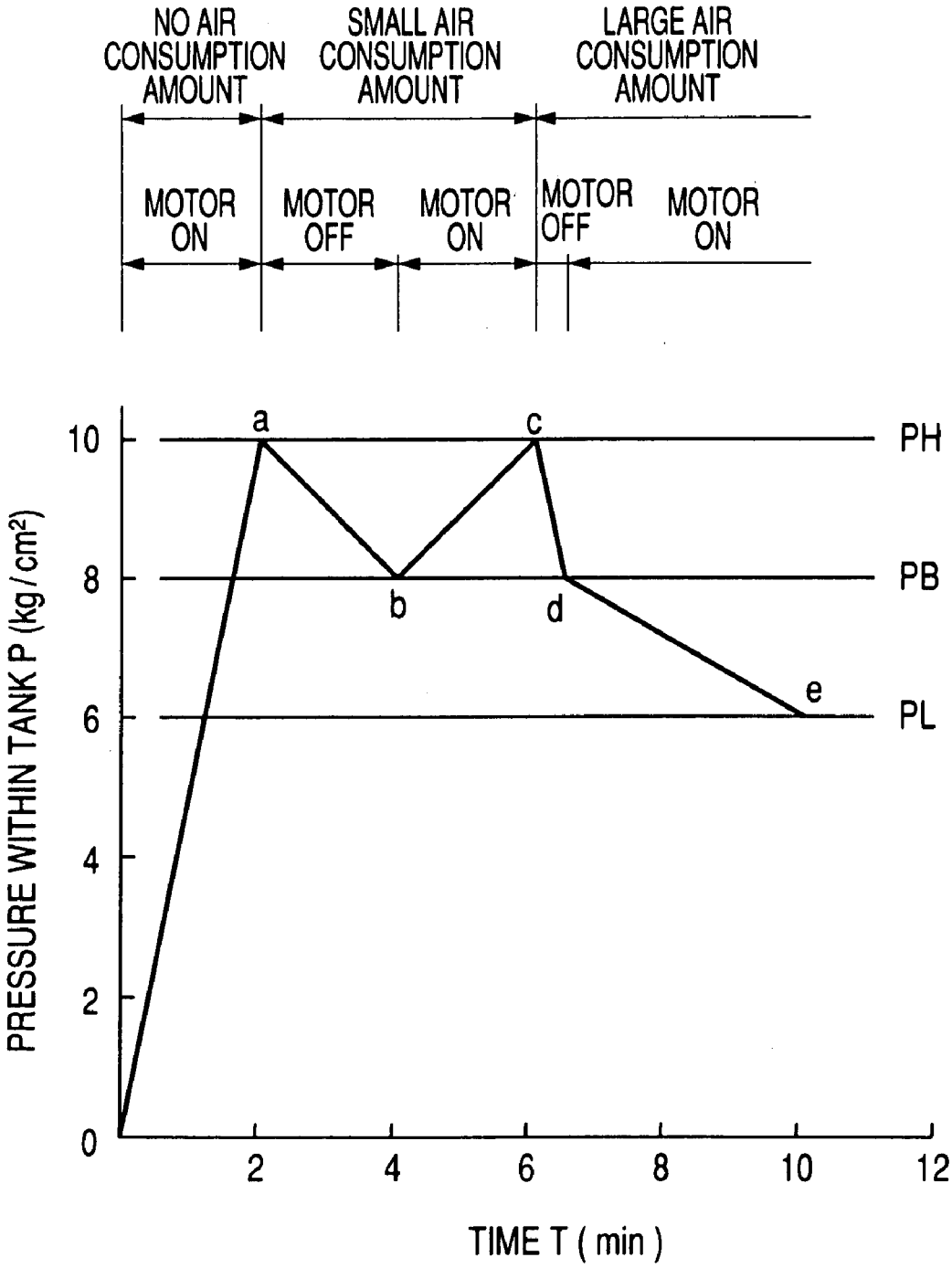
FIG. 6 RELATED ART
FIG. 6 is a pressure change curve diagram for explaining the operation of the conventional air compressor.

FIG. 5 shows an electric circuit for use with the air compressor according to the invention. The electric power is supplied from a power source 31 via the pressure switch 33 to a main switch 32.

The pressure switch 33 is composed of a switch 33$b$ and a control portion 33$a$, and has a structure that the switch 33$b$ is appropriately turned on or off by a control program built into the control portion 33$a$ upon a detection signal of the pressure sensor 11 mounted on the tank 10A.

Figure 3:
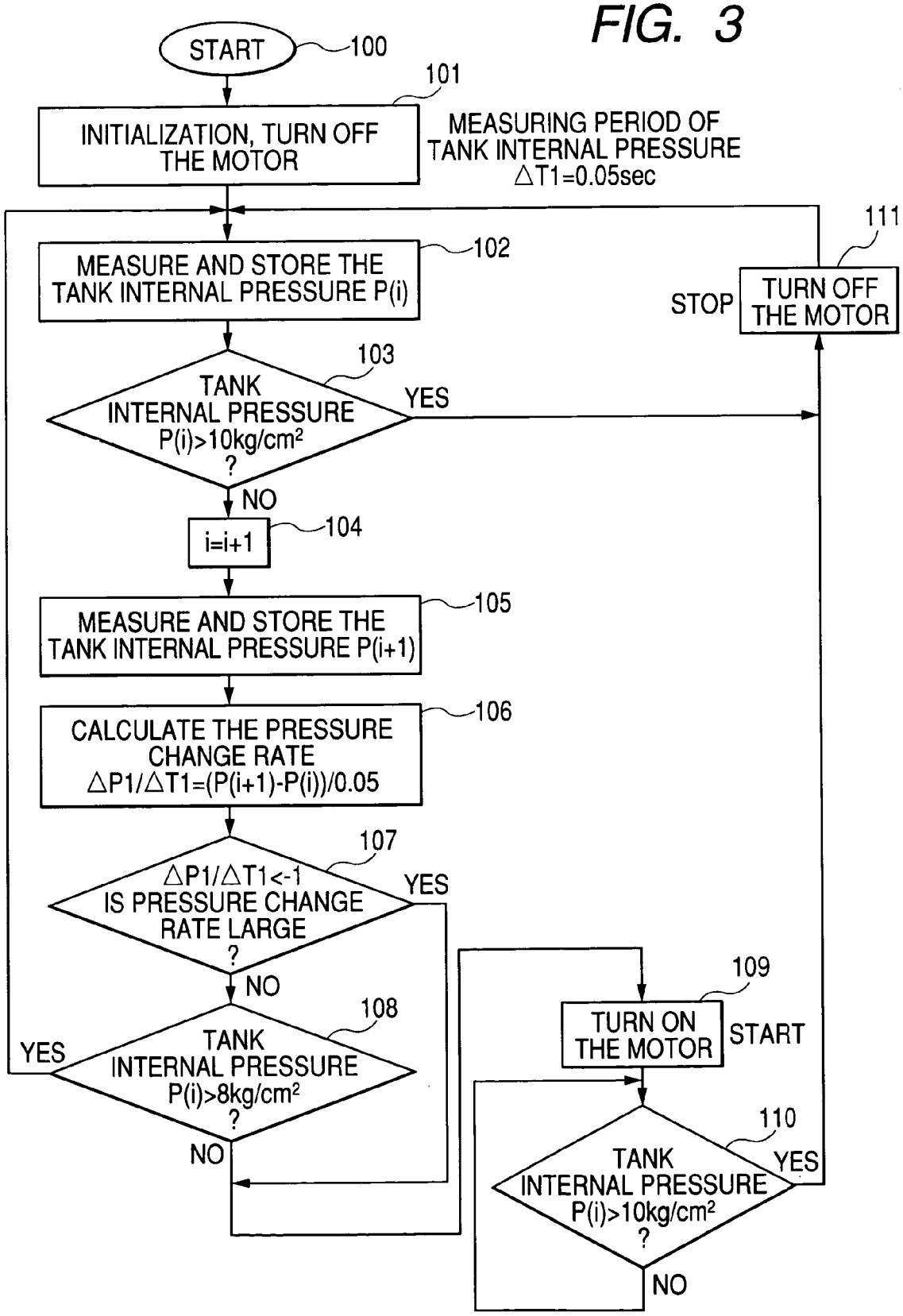
FIG. 3 is a flowchart showing a program for controlling the air compressor according to the invention.

Referring to FIG. 3, the control program built into the control portion 33 will be described below. After the main switch 32 is turned on, the initialization is firstly made at step 101 to turn the switch 33$b$ off and stop the motor 30. Also, the sampling period ΔT1 at which the detection signal of the pressure sensor 11 within the pressure tank 10A is entered into the control portion 33$a$ is set to 0.05 sec., for example. That is, supposing that the pressure within the pressure tank 10A is P(i), i=0, 1, 2, 3, . . . , the time interval between P(i) and P(i+1) is set to 0.05 sec. In this embodiment, the change in the pressure within the pressure tank 10A is detected once per 0.05 sec. This period of 0.05 sec. is set to detect the ripple in the pressure within the tank occurring in operating the nailing machine consuming a large quantity of air at a time. That is, along with the use of the air tool, the average pressure within the tank is decreased, but ΔT1 is set to detect the ripple in the pressure caused by a nailing operation, for example, rather than detecting the average value. Of course, this value depends on the air tool for use, and is not necessarily limited to the numerical value of 0.05 sec. in this invention.

Then, the procedure goes to step 102, where the pressure P(i) of compressed air within the tank 10A is measured, and stored in a memory (not shown) within the control portion 33$a$. At step 103, it is determined whether or not the measured pressure P(i) is greater than 10 kg/cm$^2$. If the determination is affirmative (YES), the procedure transfers to step 111 to turn off the motor 30. That is, in this embodiment, the pressure of the tank 10A is controlled to be kept from 8 kg/cm$^2$ to 10 kg/cm$^2$, and accordingly if the pressure within the tank exceeds 10 kg/cm$^2$, the rotation of the motor 30 is stopped.

If the determination at step 103 is negative (NO), the procedure goes to step 104 to substitute (i+1) for (i). Then, at step 105, the pressure P(i+1) within the tank is measured, and stored in the memory. Moreover, at step 106, the pressure change rate ΔP1/ΔT1 (=(P(i+1)−P(i))/0.05) at period ΔT1 is calculated. This calculation is also performed by the control portion 33$a$.

Moreover, at step 107, it is determined whether or not the pressure change rate ΔP1/ΔT1 is smaller than a predetermined value. This determination is made as to whether or not the air tool connected to the pressure tank 10A is operated to consume a large amount of air in a short time such as during the continuous nailing. In this embodiment, the predetermined value is set to −1. If the continuous nailing is performed, the pressure within the tank is pulsated, so that the ripple of the pressure change is increased. And when a decrease in ΔP1 at ΔT1 is greater than (−1) (i.e., ΔP1/ΔT1<−1), it is determined that the air tool is employed for the continuous nailing by judgement based on the magnitude of the ripple, and the procedure goes to step 109.

On the other hand, if the determination at step 107 is negative (NO), namely, if the pressure change rate within the tank in a short time (0.05 sec.) is smaller than the predetermined value, the procedure goes to step 108 to determine whether or not the pressure within the tank is greater than 8 kg/cm$^2$. If this determination is affirmative (YES), the procedure returns to step 102, or if it is negative (NO), the procedure goes to step 109 to turn on the motor 30.

Then, at step 110, it is determined whether or not the internal pressure P(i) within the tank 10A is greater than 10 kg/cm$^2$. If this determination is affirmative (YES), the procedure returns to step 111 to stop the rotation of the motor 30. If the determination at step 110 is negative (NO), the motor 30 is kept on until the determination becomes affirmative (YES).

Figure 1:
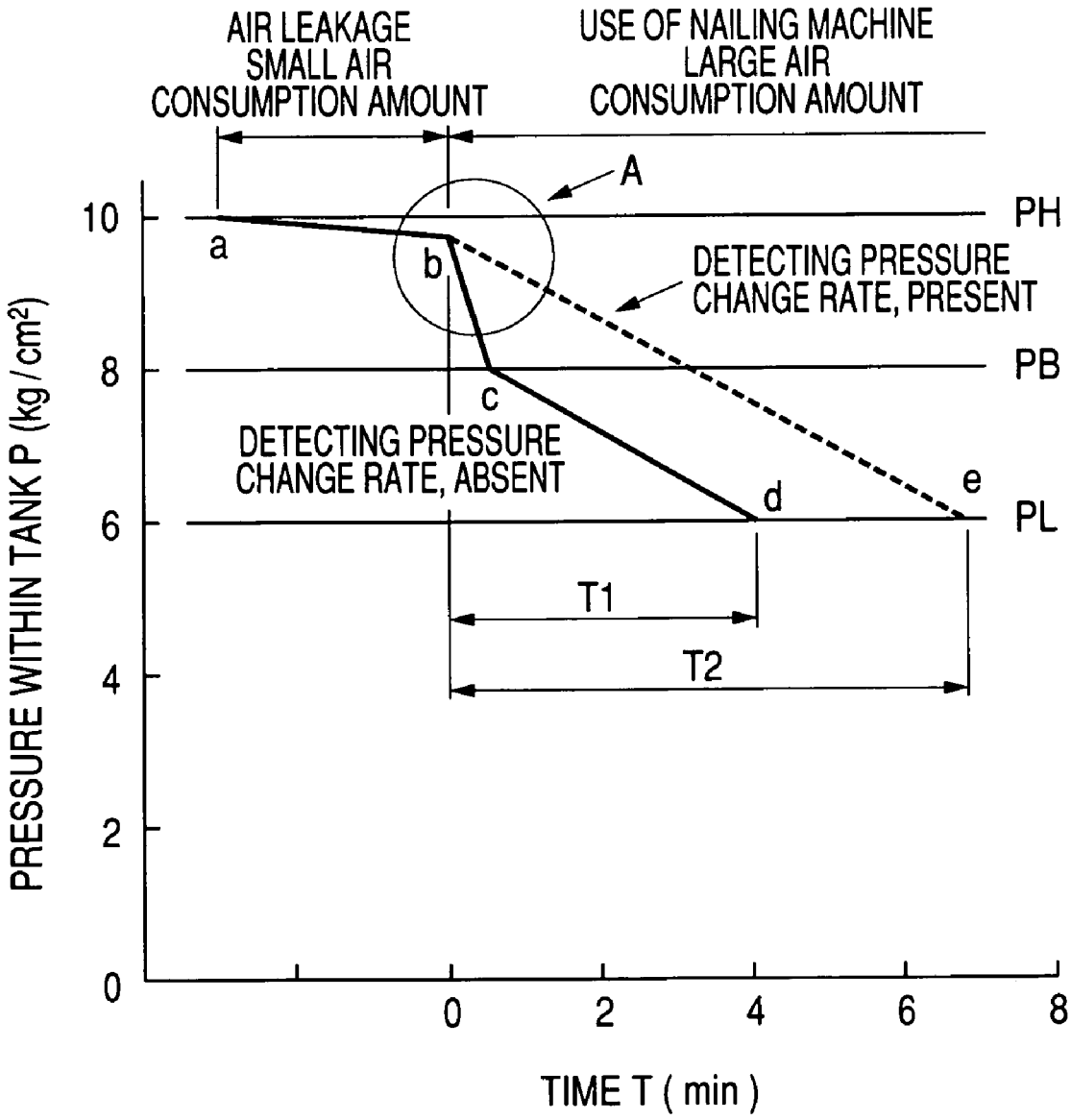
FIG. 1 is a pressure change curve diagram for explaining the operation of an air compressor according to the present invention.
Figure 2:
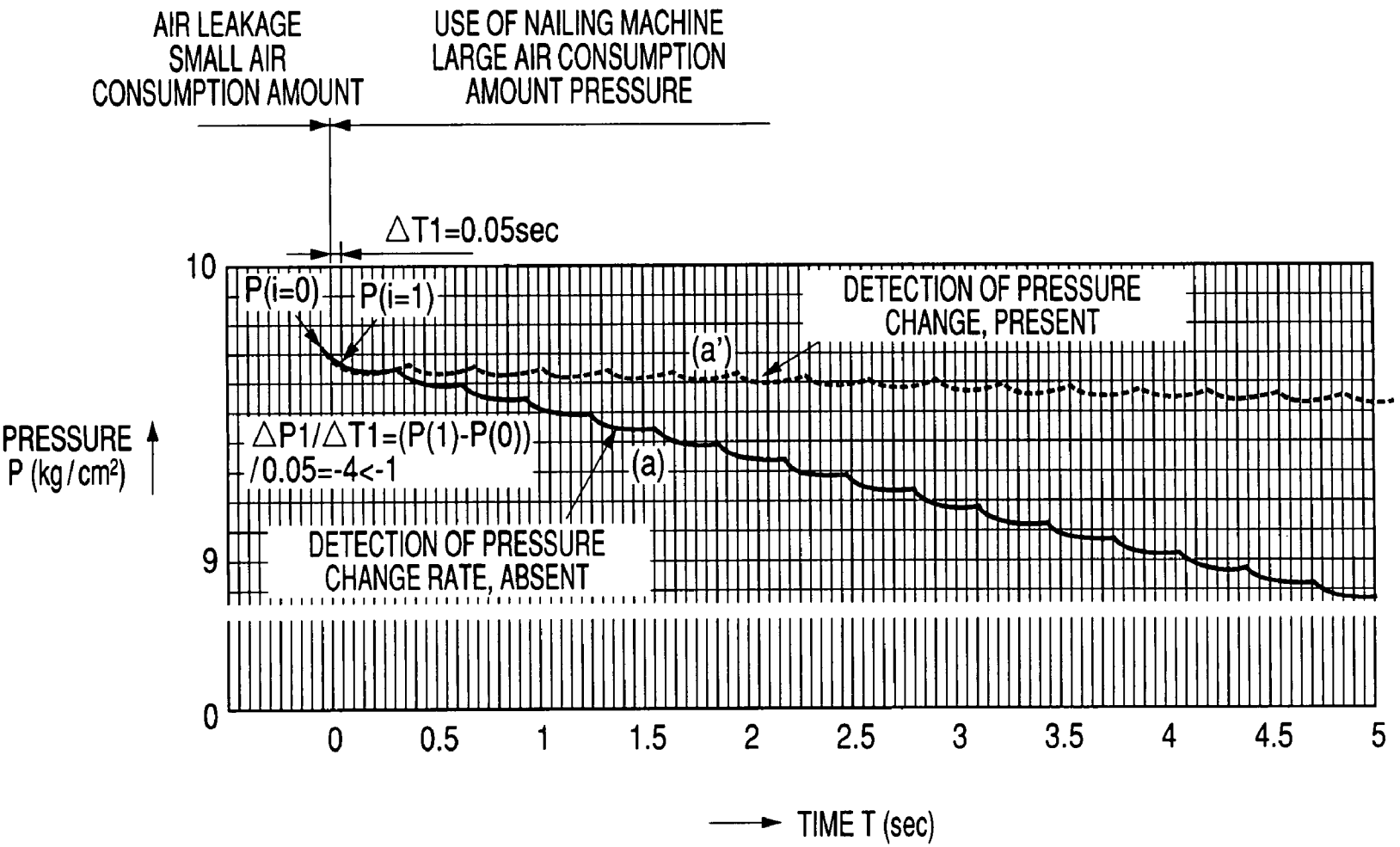
FIG. 2 is a pressure change curve diagram for explaining the operation of the air compressor according to the invention.

Referring to FIGS. 1 and 2, the operation of this inventive apparatus will be described below.

In FIG. 1, the longitudinal axis represents the pressure (kg/cm$^2$) within the air tank, and the transverse axis represents the time (min). PH denotes a pressure switch off point when the pressure rises, PB denotes a pressure switch on point when the pressure falls, and PL denotes an working critical pressure. The polygonal line abcd represents the pressure change in a case where the time change rate of the pressure within the tank is not detected as conventionally, and the polygonal line abe represents the pressure change in a case where the time change rate of the pressure within the tank is detected as in this invention.

In the interval ab, the pressure within the tank reaches PH=10 kg/cm$^2$, and the motor 30 is stopped. The air consumption is only due to air leakage from the tank until time T=0, whereby the air consumption amount is small, and the pressure within the tank is gradually decreased to 9.7 kg/cm$^2$, for example. If the continuous nailing is started by the nailing machine from the time T=0, a large quantity of air is consumed so that the pressure within the tank rapidly decreases.

In the case where the charge rate of the pressure within the tank is not detected, if the pressure within the tank rapidly decreases from point b to point c to reach the pressure switch on point PB when the pressure falls, the motor 30 is restarted. Accordingly, the decrease in the pressure within the tank is relieved, but a phenomenon of pressure decrease still continues. At point d, the pressure within the tank reaches the working critical pressure PL to disable the air tool to be employed. Accordingly, the continuous working time is indicated by T1 in this case.

On the other hand, the operation of detecting the change rate of the pressure within tank as in this invention is shown in FIG. 2.

FIG. 2 is an enlarged view of A part of FIG. 1. The transverse axis represents the time in a unit of (sec). In the curves (a) and (a'), the motor 30 is stopped till time T=0, and the pressure P within the tank at T=0 is 9.7 kg/cm$^2$. If the continuous nailing by the nailing machine is started from time T=0, for example, a large quantity of air is consumed, so that the pressure within the tank rapidly decreases while pulsating. However, the pressure change rate (=ΔP1/ΔT1) of the pressure within the tank is calculated after ΔT1=0.05 sec in this invention. Because of ΔP1/ΔT1=−4<−1, it is determined that the charge rate is greater at step 107. The motor 30 is restarted after ΔT1=0.05 sec. Therefore, the starting time of the motor is precipitated, whereby the decrease in the pressure within the tank is relieved as seen from the curve (a').

That is, if a large pressure change is detected in the tank, the motor 30 is restarted after 0.05 sec, from which point of time the decrease in the pressure within the tank is relieved. Accordingly, the pressure tends to continuously decrease and reaches the working critical pressure PL, but the continuous working time T2 is significantly longer than the conventional curve (a). In the case of the embodiment as shown in FIG. 1, T2 is about 1.5 times T1.

As will be apparent from the above description, it is not required that the pressure change rate ΔP1/ΔT1 is continuously large in this invention. If there is a point with large ΔP1/ΔT1 from PH to PB, that point makes a trigger so that the motor 30 is restarted before the pressure within the tank decreases.

As will be apparent from the above description, in the air compressor according to the invention, the time change rate of the pressure within the air tank is detected, and when the time change rate is great, the motor is immediately restarted without waiting until the pressure decreases to the pressure switch off point at the time of pressure fall, whereby the continuous working time up to reaching the working critical pressure is extended.

What is claimed is:

1. A pressure switch mechanism comprising:

a pressure vessel;

a pressure sensor which senses a pressure within the pressure vessel at a predetermined time interval ΔT1;

a load;

a switching unit which switches a feed line of the load; and a control unit which controls the switching unit in accordance with a signal of the pressure sensor, wherein the control unit controls said switching unit in one of a first mode and a second mode depending on a pressure change rate within the time interval ΔT1, wherein said first mode is such that the switching unit is turned on when a pressure of said pressure vessel becomes a first value and is turned off when the pressure of said pressure vessel becomes a second value greater than the first value, when said pressure change rate is smaller than a predetermined value, and wherein said second mode is such that said switching unit is turned on when the pressure of said pressure vessel becomes a third value between the first value and the second value and is turned off when the pressure of the pressure vessel becomes the second value, when said pressure rate is greater or equal to said predetermined value.

2. The air compressor according to claim 1, further comprising at least one compressed air opening disposed on said pressure vessel.

3. The air compressor according to claim 2, further comprising at least one pressure reducing valve disposed at said at least one compressed air opening.

4. The air compressor according to claim 3, wherein said at least one pressure reducing valve has a maximum pressure of compressed air on an outlet side.

5. The air compressor according to claim 3, further comprising at least one pressure gauge attached to said pressure reducing valve to monitor a pressure of compressed air on an outlet side.

6. An air compressor comprising:

a tank portion which reserves a compressed air;

a compressed air generating portion which generates the compressed air to be supplied to the tank portion;

a motor driving the compressed air generating portion;

a switching unit which switches a feed line of the motor;

a pressure sensor which senses a pressure of the tank portion at a predetermined time interval ΔT1; and a control unit controlling the switching unit to be turned on or off in accordance with a signal of the pressure sensor, wherein the control unit controls said switching unit in one of a first mode and a second mode depending on a pressure change rate within the time interval ΔT1, wherein said first mode is such that the switching unit is turned on when a pressure of said pressure vessel becomes a first value and is turned off when the pressure of said pressure vessel becomes a second value greater than the first value, when said pressure change rate is smaller than a predetermined value, and wherein said second mode is such that said switching unit is turned on when the pressure of said pressure vessel becomes a third value between the first value and the second value and is turned off when the pressure of the pressure vessel becomes the second value, when said pressure rate is greater or equal to said predetermined value.

7. The air compressor according to claim 6, further comprising at least one compressed air opening disposed on said tank portion.

8. The air compressor according to claim 7, further comprising at least one pressure reducing valve disposed at said at least one compressed air opening.

9. The air compressor according to claim 8, wherein said at least one pressure reducing valve has a maximum pressure of compressed air on an outlet side.

10. The air compressor according to claim 8, further comprising at least one pressure gauge attached to said pressure reducing valve to monitor a pressure of compressed air on an outlet side.

11. The air compressor according to claim 6, wherein an air tool is connected to the air compressor and the time interval ΔT1 is set to be able to detect a ripple in a pressure within said tank, and wherein the ripple is caused by the use of the air tool.

12. A control method for an air compressor that includes a tank portion which reserves a compressed air, a compressed air generating portion which generates the compressed air to be supplied to the tank portion, a motor driving the compressed air generating portion, a switching unit which switches a feed line of the motor, a pressure sensor which senses a pressure of the tank portion and a control unit controlling the switching unit to be turned on or off in accordance with a signal of the pressure sensor, the method comprising:

sensing a pressure P(i) of the tank portion at a predetermined interval ΔT1;

controlling the switching unit to be turned on when the pressure of the tank portion is at a first value and turned off when the pressure of the tank portion is at a second value in a case where a pressure change detected at the predetermined time interval ΔT1 is smaller than a predetermined value; and controlling the switching unit to be turned on when the pressure of the tank portion is at a third value between the first value and the second value and turned off when the pressure of the tank portion is at the second value in a case where the pressure change rate detected at the predetermined time interval ΔT1 is greater or equal to the predetermined value.

13. The method according to claim 12, further comprising sensing the pressure of the tank portion at a time interval at which ripples in the pressure of the tank portion caused by the use of an air tool is detected.

14. The method according to claim 12, further comprising sensing the pressure of the tank portion at a regular interval.

15. The method according to claim 12, further comprising controlling the switching unit to be turned on when the pressure of the tank portion is a first value, turned off when the pressure of the tank portion is a second value, and turned on at a third value different from the first and second values when a pressure change rate of the tank portion is greater than or equal to a predetermined value.

16. An air compressor comprising:

a tank portion which reserves a compressed air to be used for a pneumatic tool;

a compressed air generating portion which generates the compressed air to be supplied to the tank portion;

a motor for driving the compressed air generating portion;

an electric power source;

a switching unit connected between the motor and the electric power source;

a pressure sensor which senses a pressure of the tank portion; and a control unit which receives a signal from the pressure sensor to calculate a pressure change rate within the tank portion and controls the switching unit, wherein the control unit controls the switching unit to be turned on when the pressure of the tank portion reaches a first value and turned off when the pressure of the tank portion reaches a second value when the pressure change rate is below a predetermined value, and wherein the control unit controls the switching unit to be turned on when the pressure of the tank portion reaches a third value between the first value and the second value and turned off when the pressure reaches the second value when the pressure change rate is equal to or greater than a predetermined value.

17. An air compressor comprising:

a tank portion which reserves a compressed air to be used for a pneumatic tool;

a compressed air generating portion which generates the compressed air to be supplied to the tank portion;

a motor for driving the compressed air generating portion;

an electric power source;

a switching unit connected between the motor and the electric power source;

a pressure sensor which senses a pressure of the tank portion; and a control unit which receives a signal from the pressure sensor to calculate a pressure change rate within the tank portion and controls the switching unit, wherein the control unit controls the switching unit to be turned on when the pressure of the tank portion reaches a first value and turned off when the pressure of the tank portion reaches a second value when an amount of compressed air consumed by the tool within a predetermined time interval is below a predetermined value, and wherein the control unit controls the switching unit to be turned on when the pressure of the tank portion reaches a third value between the first value and the second value and turned off when the pressure of the tank portion reaches a second value when the amount of compressed air consumed by the tool within a predetermined time interval is equal to or greater than the predetermined value.

* * * * *